United States Patent [19]

Meinhardt et al.

[11] Patent Number: 4,504,015

[45] Date of Patent: Mar. 12, 1985

[54] METHOD FOR DESTROYING USED CARBON RIBBON

[75] Inventors: Heinrich Meinhardt; Alfons Berger, both of Nuremberg; Harald Zimmerman, Herrieden, all of Fed. Rep. of Germany

[73] Assignee: Triumph-Adler A.G. fur Buro und Informationstechnik, Nuremberg, Fed. Rep. of Germany

[21] Appl. No.: 420,131

[22] Filed: Sep. 20, 1982

[30] Foreign Application Priority Data

Sep. 10, 1981 [DE] Fed. Rep. of Germany ..... 3135897

[51] Int. Cl.[3] ..... B02C 19/12

[52] U.S. Cl. ..... 241/3; 241/30; 241/101.5; 400/227.1

[58] Field of Search ..... 241/3, 30, 274, 101.5, 241/300.1, 301, 283; 83/924; 242/56 B, 56 R, DIG. 2; 400/227.1

[56] References Cited

U.S. PATENT DOCUMENTS

| | | | |
|---|---|---|---|
| 3,026,060 | 3/1962 | Norehad | 242/56 B |
| 3,330,399 | 7/1967 | Tumavicus | 400/227.1 |
| 3,640,480 | 2/1972 | Schleich | 242/56 R |

OTHER PUBLICATIONS

Western Electric, Traverse-Wound Spools for Component Taping Machine, Ingham, p. 21, Technical Digest No. 27, Jul. 1972.

*Primary Examiner*—Howard N. Goldberg
*Assistant Examiner*—Joseph M. Gorski

[57] ABSTRACT

Disclosed is a method for destroying used carbon ribbons so that individual carbon ribbon segments are formed by cutting with a knife. The used carbon ribbon is wound spirally on the reel by axially moving the reel during a winding process and by maintaining this motion during a cutting process. A multitude of individual carbon ribbon segments with cut edges running obliquely to the longitudinal edges of the carbon ribbon are thereby produced.

2 Claims, 7 Drawing Figures

METHOD FOR DESTROYING USED CARBON RIBBON

This invention relates to a method for destroying used carbon ribbon so that text imprinted thereon is made unreadable.

It is frequently demanded that the text imprinted on one-time carbon ribbons be destroyed in such a manner that it is no longer possible to read what has been written. Due to the plastic film foundation used in such carbon ribbons, destruction is not simple in that plastic film ribbon is very tough, and is very extensible. Therefore, tearing the carbon ribbon is nearly impossible. Because the plastic film ribbon foundation is quite thin pulling the ribbon between cutter blocks oftentimes results in the ribbon passing between the cutter blocks without being cut.

An object of the invention to provide a method for destroying used carbon ribbons.

Another object of the invention is in the provision of means for spirally winding used and, while the reel is rotating and moving axially, for cutting the wound used ribbon into segments.

Another object of the invention is in the provision of a device for destroying ribbons which can be produced inexpensively, and which can be made in a size which can be accommodated in an office for use by an operator to make used carbon ribbon immediately illegible without handling the ribbon.

Other objects, features and advantages of the present invention will become better known to those skilled in the art from a reading of the following detailed description when taken in conjunction with the accompanying drawing wherein like reference numerals designate like or corresponding elements throughout the several view thereof and wherein.

Figure 1:
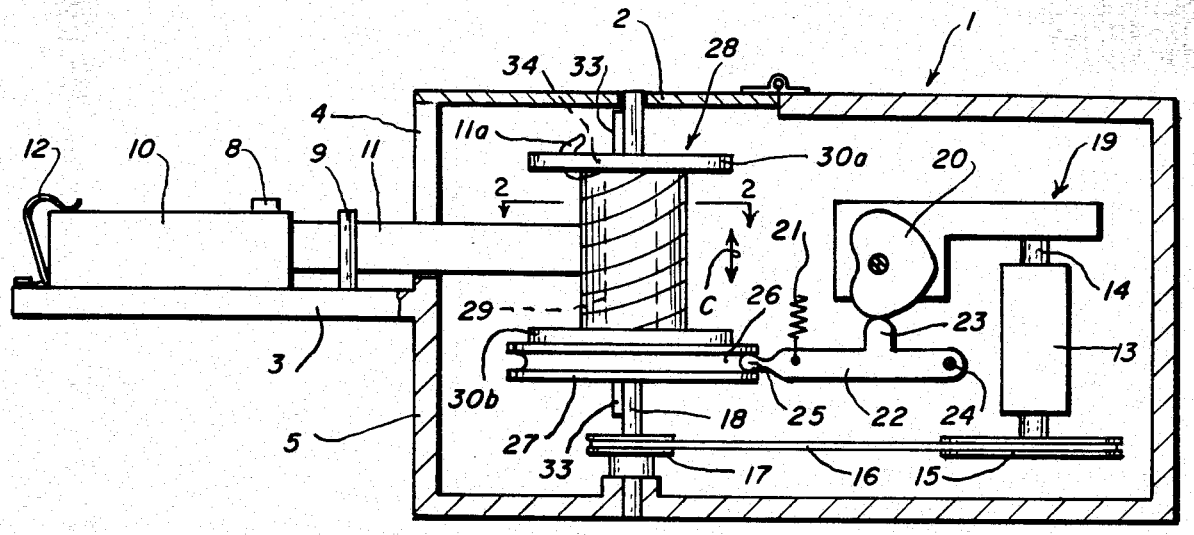
FIG. 1 is an elevational view partially in section of a carbon ribbon shredder.
Figure 4:
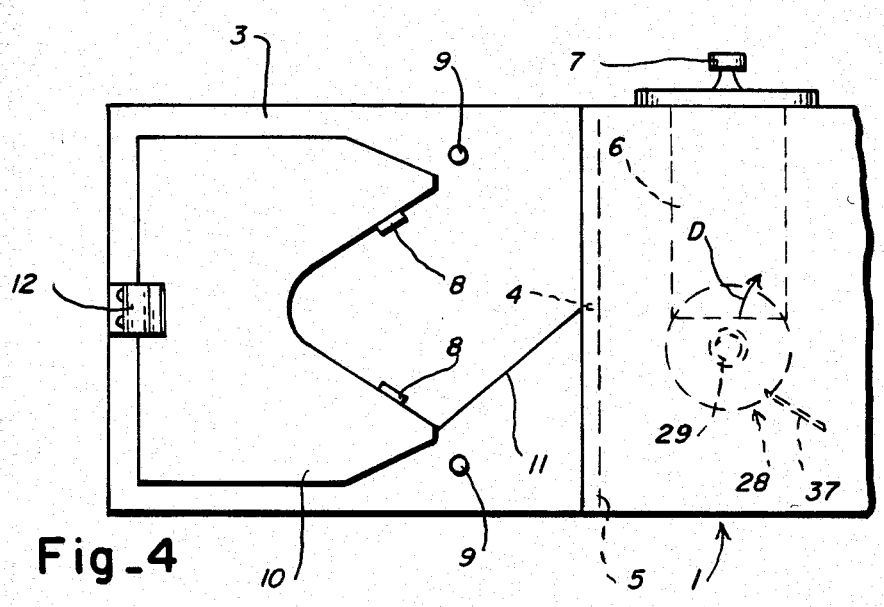
FIG. 4 is a partial plan view of the shredder shown in FIG. 1

Referring now to the drawing there is shown in FIG. 1 a box-shaped housing generally designated by reference numeral 1 having a lid 2 hinged to the top thereof. Extending laterally from the housing 1 is a support platform 3 located below a slot 4 in the front panel 5 of the housing and, as shown in FIG. 4, one side of the housing supports a pull out cut ribbon receptacle 6 with a pull out knob 7. The support platform 3 has contact lugs 8 and/or studs 9 which serve to firmly secured differently designed ribbon cartridges containing used carbon ribbon 11 in secure position on support platform 3. Further a retention bracket, which may take the form of a spring clip 12, may be provided to secure a mounted cartridge 10. While a ribbon cartridge 10 is shown it is to be understood that spools of used carbon ribbon could be positioned on platform 3 as well.

A motive source in the form of an electric motor 13 is shown arranged and suitably supported in the housing 1. However, it is to be understood that a hand-operated crank, protruding from the housing 1, could also be used as a motive source. As shown in FIG. 1 the motor 13 has a shaft 14 which at one end is fitted with a pulley 15. A belt 16 trained about pulley 15 and a second pulley 17 which is fitted to a shaft 18 to transmit rotary motion to shaft 18 which is vertically supported in the housing. The diameters of pulleys 15 and 17 are selected so as to provide a step-up to a higher speed on shaft 18.

The other end of the motor drive shaft 14 extending from the other side of the housing of the motor 13 is coupled to a step down transmission generally designated by reference numeral 19 for driving a cam plate 20. The transmission 19 may be designed e.g. as a gear transmission. Urged against the cam plate 20 under the action of a spring 21, is a cam follower arm 22. The cam follower arm 22 is pivoted at one end as at 24 and is provided intermediate its ends with a projection 23 which bears against and follows the contour of the cam plate 20. The free end of the cam follower arm 22 is designed as a head 25 which engages in a peripheral groove 26 on a disc 27 keyed to shaft 18. As can be seen from FIG. 1 the cam plate 20 acts on the cam follower arm 22 whose pivoting movement is transmitted to the disc 27, so that the latter is axially displaceable on shaft 18.

Figure 2:
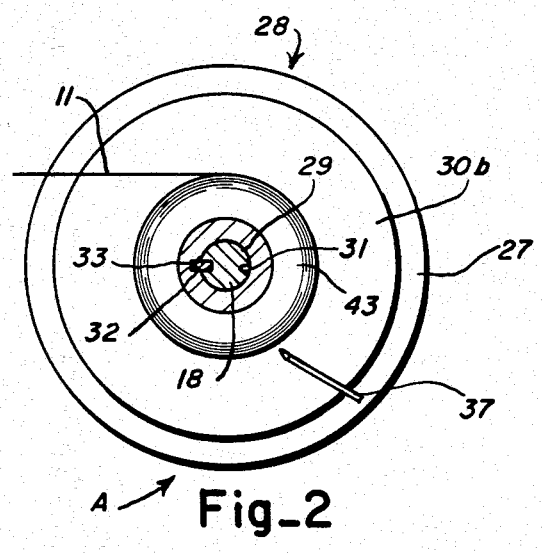
FIG. 2 is a sectional view of a used ribbon take up reel taken along lines 2—2 of FIG. 1 for spirally winding used carbon ribbon.

The disc 27 serves as support for a reel 28 which comprises a core 29 having upper and lower flanges 30*a* and 30*b*. The reel core 29 has a bore 31 provided with an axial keyway 32. As shown in FIG. 2 the shaft 18 has a key 33 which, when the reel 28 is mounted on shaft 18, engages in the keyway 32. This allows the reel 28 to move axially as it is rotated. The upper flange 30*a* of reel 28 has a retaining slot 34, into which the lead end 11*a* of the carbon ribbon 11 can be threaded, so that the ribbon winds on reel 28 when the reel rotates. Alternatively, e.g. a spring clip or other suitable means may be provided for fixing the lead end 11*a* of used carbon ribbon 11 to be wound.

Figure 3:
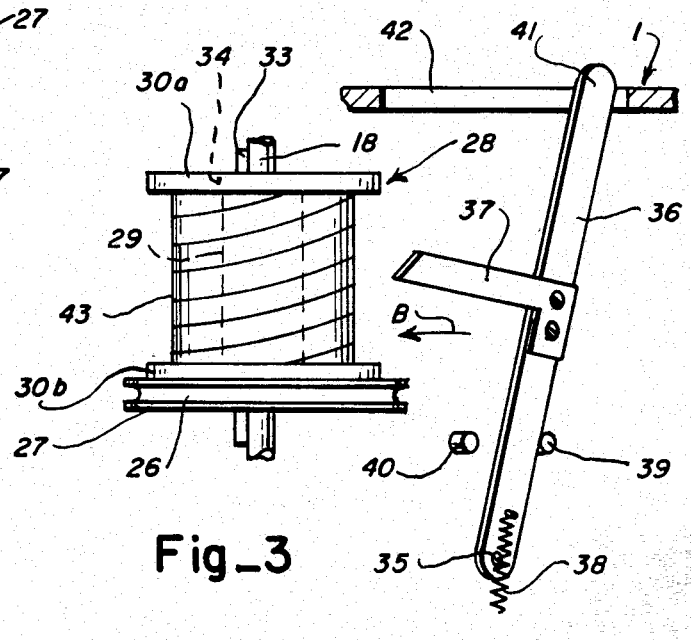
FIG. 3 is an elevational view of the reel and of a cutting knife as viewed in the direction of arrow A in FIG. 2.

With reference to FIG. 3 a bolt 35 pivotally supports the lower end of a lever 36. The lever 36 carries a preferably exchangeable cutting knife 37 which upon movement of lever 36 brings the knife 37 into and away from engagement with used ribbon 11 wound on the reel 28. A spring 38 normally pulls the lever 36 to an overcenter position against a stop 39 when lever 36 is in its inoperative position. When lever 36 is swung beyond its dead center in the direction of arrow B, spring 38 pulls lever 36 to an operative overcenter position towards an additional stop 40, which limits the operative position of lever 36. To pivot the lever 36 with the cutting knife 37 by hand, a handle 41 extends through a slot 42 in the top wall of the housing 1. For reasons of clarity of the drawing, the lever 36 with cutting knife 37 is not shown in FIG. 1, but is clearly visible in FIG. 3. As shown in FIG. 2 the cutting knife 37 is oriented in its pivot plane so that it approaches the reel core approximately tangentially. This arrangement has proved favorable for the cutting process still to be described. Stop 40 is arranged so that it limits the operative movement (arrow B) of lever 36 before knife 37 can come in contact with the empty reel core 29.

In accordance with the invention a used ribbon cartridge 10 is placed on the support platform 3 and is secured between the contact lugs 8 and the retaining spring clip 12. Then, with the hinged lid 2 of housing 1 open, the end 11*a* of the carbon ribbon 11 is inserted through slot 5 on the front panel 5 and placed in a retaining slot 34 on flange 30*a* of reel 28. By a few turns of the reel 28 by hand, the carbon ribbon 11 is thus fastened to reel 28.

After closing the hinged lid 2, the motor 13 can be activated. In accordance with a preferred embodiment the motor on-off switch may be located so that it is actuated by means of the closed hinged lid 2, whereby the motor is turned off if, during operation of the device, the hinged lid 2 is opened thereby to avoid injury to an operator by moving parts of the device.

In operation the motor 13 drives pulley 15 and, via belt 16, pulley 17 whereby the shaft 18 is driven thereby, via the key 33 thereof, to drive the disc 27 and the reel 28 in the direction of rotation. In an alternative the disc 27 can be arranged on shaft 18 in such a way that it is not rotated by the shaft 18 but is only axially movable relative thereto.

The motor 13 also rotates the cam plate 20 through transmission 19 causing the cam follower arm 22 to oscillate continuously, thereby, via the connection of head 25 with the groove 26 in the disc 27, to axially oscillate disc 27 and reel 28 up and down on shaft 18 in regular strokes indicated by arrow C. This axially oscillating movement, in conjunction with the rotation of reel 28, results in the carbon ribbon 11 being spirally wound on the reel core 29 in a spiral coil 43. It is obvious that the pitch of the individual layers of the carbon ribbon coil 43 depends on the speed of rotation of reel 28 and on the frequency with which it is oscillated axially up and down in the direction of arrow C. It is expedient, therefore, to match the speed of rotation and rate of stroke of the reel 28 such that a uniform and smooth coil 43 results. This is readily achieved by proper selection of the transmission ratios in the belt drive 15, 16, 17 and in transmission 19.

Figure 5:
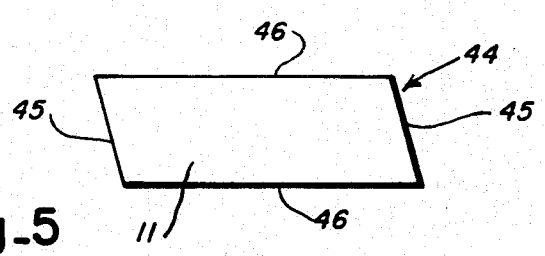
FIG. 5 is a plan view of a cut-off carbon ribbon segment.

After the entire carbon ribbon 11 is wound on core 29 of reel 28, lever 36 can be swung over in the direction of arrow B by means of its handle 41. When in so doing spring 38 has caused lever 36 to move to operative overcenter position, the tip of the cutting knife 37 is urged against the outermost layer of the carbon ribbon coil 43 on the rotating and axially oscillating reel and cuts into the ribbon. This results in cutting off of discrete carbon ribbon segments 44. A cut segment is shown in FIG. 5 which shows cut edges 45 running obliquely to the longitudinal edges 46 of the carbon ribbon 11. The angle of the cut edges 45 to the longitudinal edges 46 is also determined by the ratio of speed of rotation to the frequency of oscillation in axial direction. The length of the individual segments 44 depends on the diameter of carbon ribbon coil 43. This means also that the segments 44 become shorter with decreasing diameter of coil 43.

As has been observed, individual carbon ribbon segments 44 will all fly off in the direction of arrow D (FIG. 4) due to the centrifugal force of rotating reel 28. This is because the speed of rotation of reel 28 remains largely constant and the cutting knife 37 acts in the manner of a deflector. It is thus relatively easy to collect the carbon ribbon segments 44 in a collecting container, e.g. the drawer 6, from which the collected segments 44 can then be dumped out. Instead of the drawer 6, a discardable receptacle in the form of a bag could be provided, designed to be removably fastened over a lateral opening in the housing 1 which lies in the line of flight of the carbon ribbon segments 44.

The cutting process is ended when lever 26 bears against stop 40 which is located to assure that the cutting knife 37 will not come in contact with the empty reel core 29. After completing cutting, lever 36 can be swung back to its inoperative position against stop 39 and the drive mechanism 13 turned off. The device is then ready for the winding and shredding of another carbon ribbon 11.

Since, in accordance with the invention a used carbon ribbon 11 is cut into many segments 44 of different lengths, it is no longer possible to reassemble the ribbon to enable the text to be read coherently. A contributing factor is the obliquely extending cut edges 45 of the carbon ribbon segments 44.

In an alternative, instead of axially oscillating the reel 28 while the carbon ribbon 11 is being wound, a guide located in slot 4 leading the used ribbon could be mounted for oscillation. Such an arrangement would be suitable primarily for carbon ribbons consisting of a sturdy film.

Figure 7:
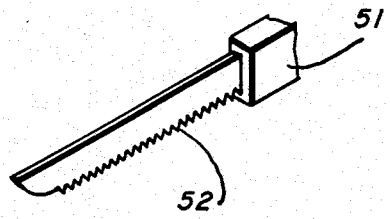
FIG. 7 is a perspective view of a cutting knife for the embodiment shown in FIG. 6.
Figure 6:
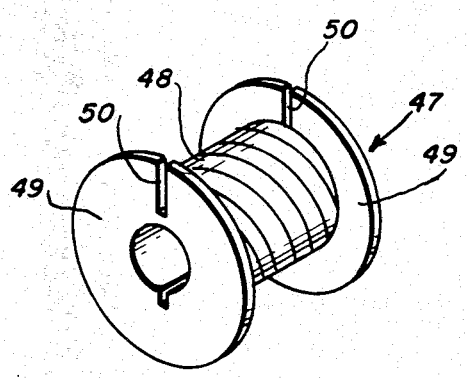
FIG. 6 is a perspective view of a reel in accordance with another embodiment.

A simpler embodiment of the device for carrying out the method of the invention is shown in FIGS. 6 and 7. Let it be assumed that the carbon ribbon 11 is spirally wound on a reel 47 (FIG. 6), by means of a device shown in FIG. 1. Reel 47 is shown with flanges 49, each of which is provided with a radial slot 50 which are aligned to accommodate a cutting knife 51, preferably having a wavy cutting edge 52. In this embodiment the carbon ribbon coil 48 is first removed from the housing and cut into segments 44 by moving the knife 51 back and forth in the slots 50 while pressing it against the coil 48. While the cut edges of the segments in this embodiment are not oblique, reassembly to read the text is practically impossible.

The invention claimed is:

1. A method for destroying used carbon ribbons by shredding comprising the steps of spirally winding a multilayered coil of ribbon on a core of a reel by securing one end of a used carbon ribbon to a rotating and axially oscillating reel, and, after the ribbon is wound on the core of said reel and while the reel is rotating and axially oscillating, urging a cutter toward and transverse the core of said reel, thereby to cut through the multilayered sprially wound coil of used carbon ribbon and to throw off a multitude of individual trapezoidal shaped segments resulting from the cutting.

2. A method as recited in claim 1, including the step of collecting cut ribbon segments hurled away by centrifugal force from the rotating reel for disposal.

* * * * *